US009988893B2

(12) United States Patent
McCoy

(10) Patent No.: US 9,988,893 B2
(45) Date of Patent: Jun. 5, 2018

(54) INSTRUMENTED WELLBORE CABLE AND SENSOR DEPLOYMENT SYSTEM AND METHOD

(71) Applicant: TouchRock, Inc., Magnolia, TX (US)

(72) Inventor: Brian Kelly McCoy, Magnolia, TX (US)

(73) Assignee: Touchrock, Inc., Magnolia, TX (US)

( * ) Notice: Subject to any disclaimer, the term of this patent is extended or adjusted under 35 U.S.C. 154(b) by 425 days.

(21) Appl. No.: 14/639,541

(22) Filed: Mar. 5, 2015

(65) Prior Publication Data

US 2016/0258271 A1 Sep. 8, 2016

(51) Int. Cl.

| | |
|---|---|
| ***E21B 47/01*** | (2012.01) |
| ***E21B 47/00*** | (2012.01) |
| ***E21B 17/02*** | (2006.01) |
| ***E21B 19/08*** | (2006.01) |

(52) U.S. Cl.

CPC ..... *E21B 47/01* (2013.01); *E21B 17/026* (2013.01); *E21B 19/08* (2013.01); *E21B 47/00* (2013.01)

(58) Field of Classification Search

CPC ..... E21B 47/01; E21B 47/00; E21B 19/08; E21B 17/026

See application file for complete search history.

(56) References Cited

U.S. PATENT DOCUMENTS

| | | | | |
|---|---|---|---|---|
| 6,446,723 | B1 | 9/2002 | Ramos et al. | |
| 6,910,534 | B2 | 6/2005 | Linyaev et al. | |
| 7,455,106 | B2 | 11/2008 | Veneruso et al. | |
| 7,552,764 | B2 | 6/2009 | Weems et al. | |
| 7,617,873 | B2 | 11/2009 | Lovell et al. | |
| 7,654,315 | B2 | 2/2010 | Du et al. | |
| 7,784,537 | B2 | 8/2010 | Baxter | |
| 7,845,061 | B2 | 12/2010 | Buytaert et al. | |
| 8,082,988 | B2 | 12/2011 | Redlinger et al. | |
| 8,678,088 | B2 | 3/2014 | Brown | |
| 8,720,553 | B2 | 5/2014 | Tips et al. | |
| 8,737,774 | B2 | 5/2014 | MacDougall et al. | |
| 8,746,337 | B2 | 6/2014 | Grigsby et al. | |
| 8,800,650 | B2 | 8/2014 | Spray et al. | |
| 2001/0050111 | A1 | 12/2001 | Neuroth et al. | |
| 2005/0236161 | A1 | 10/2005 | Gay et al. | |
| 2006/0151194 | A1* | 7/2006 | Varkey | H01B 7/046 174/102 R |
| 2008/0006400 | A1* | 1/2008 | Coyle, Jr. | E21B 17/026 166/77.1 |

(Continued)

FOREIGN PATENT DOCUMENTS

| | | | |
|---|---|---|---|
| WO | 2013134201 | A1 | 9/2013 |

OTHER PUBLICATIONS

Weatherford, Roller Cross-Coupling Control-Line Protector, Weatherford Cementing Products Brochure 2012, 3 pages.

(Continued)

*Primary Examiner* — Giovanna C. Wright
*Assistant Examiner* — Manuel C Portocarrero
(74) *Attorney, Agent, or Firm* — David W. Carstens; James H. Ortega; Carstens & Cahoon, LLP

(57) ABSTRACT

A system and method for rapid deployment of fiber optic distributed sensing cables, conventional electronic cables, or hydraulic control lines in the annulus of a wellbore along a specific well zone without the need to clamp cables to the casing or tubing string for support.

15 Claims, 8 Drawing Sheets

(56) References Cited

U.S. PATENT DOCUMENTS

| | | | | |
|---|---|---|---|---|
| 2008/0041596 | A1* | 2/2008 | Blount | E21B 17/20 166/380 |
| 2008/0066905 | A1 | 3/2008 | Aivalis et al. | |
| 2012/0010846 | A1* | 1/2012 | Brian | G01F 23/22 702/134 |
| 2013/0118757 | A1 | 5/2013 | Barrilleaux et al. | |
| 2013/0309888 | A1 | 11/2013 | Nicholson | |
| 2014/0083714 | A1 | 3/2014 | Grigsby | |
| 2014/0144615 | A1 | 5/2014 | Richards | |
| 2014/0202767 | A1 | 7/2014 | Feasey | |

OTHER PUBLICATIONS

TubeTec Website Encapsulated Control Line Print Screen printed Sep. 16, 2014, from http://www.tubetec.co.uk/ 1 page.
Tesco Corporation, Multiple Control Line Running System (MCLRS), Tesco bulletin 47100e 2008, 1 page.
Schlumberger, Permanent Downhole Cable Product Information Sheet 2014, 2 pages.
Prysmian Group, Tubing Encapsulated Cable Brochure, 6 pages.
Halliburton, Flatpack, Completion Solutions Brochure 2013, 1 page.

* cited by examiner

INSTRUMENTED WELLBORE CABLE AND SENSOR DEPLOYMENT SYSTEM AND METHOD

CROSS REFERENCE TO RELATED APPLICATIONS

Not Applicable

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention generally relates to deployment of instrument cables and control lines in an oil and gas wellbore. Specifically, the present invention provides a system and method for rapid deployment of fiber optic sensors and distributed sensing cables, electronic sensors and conventional electronic cables, capillary tubing, or hydraulic control lines in the annulus of a wellbore along a specific well zone without the need to clamp cables to the casing or tubing string for support.

PRIOR ART AND BACKGROUND OF THE INVENTION

Prior Art Background

Economic challenges have created the necessity for increased efficiency and precision of hydrocarbon production methods. Deploying instruments into the wellbore that capture data from specific zones can help achieve these efficiencies.

Advancements in distributed fiber optic sensing ("DxS") technologies have resulted in such technologies becoming economically competitive with conventional logging methods. The barrier to wider use of DxS and other down-hole instruments by well operators has been relatively high installation costs.

In most cases, the standard casing program does not provide adequate clearance for current cable installation. This necessitates upsizing the entire casing and wellbore program to accommodate the necessary fiber cables, "marker" cables and associated clamps or centralizers that are run on the outside of the casing. The costs associated with drilling larger diameter wellbores can range from $500,000 to over $1 million, per well, in addition to the rig time for placement of clamps and centralizers.

The current industry practice for deploying instrumented cables and control lines behind casing or in the casing-tubing annulus is to rigidly attach the cables to the casing or tubing with bands or clamps that support the weight of the cable and deliver it down-hole. These clamps or bands may increase the outer running diameter of the casing string, which may necessitate upsizing of the well-bore to provide sufficient running clearance and reduce the risk of cable damage during installation transit.

While running these types of completions, the casing or tubing cannot be rotated without potential damage to the cables or control lines. The cables and control lines are typically installed from spools located some distance away from the rig. A cable sheave is then suspended above the rig floor to guide and position the cable relatively parallel to the casing or tubing so that it can be manually clamped into place. The suspended sheave load above the rig floor creates a potential safety hazard from failure of the suspending means and the load falling on rig personnel.

It may also be desirable during the drilling phase of a well to temporarily run certain fiber optic or electronic sensors into the annular space between the wellbore and drill pipe to better obtain geophysical parameters. Conventional logging systems are typically run inside the drill pipe which may act as an insulator and attenuate some sensor signals causing erroneous or weak signals.

Deficiencies in the Prior Art

The prior art as detailed above has the following deficiencies:

- Prior art systems present a safety hazard to workers on the rig floor due to heavy loads comprising cable sheaves to be suspended above the rig floor.
- Prior art systems do not provide for rotation of the casing or tubing without the risk of damaging the sensor cable.
- Prior art systems require use of bands or clamps to rigidly attach instrument cables to the outside of the casing which many times requires drilling a larger diameter wellbore and thus increasing operational costs and drilling time.
- The prior art systems require labor-intensive efforts to manually attach the instrument cables to the casing thus increasing labor costs and drilling times.
- The prior art systems involve the expense of upsizing wellbores to accommodate the bands or clamps on the casing exterior.
- Prior art systems are typically not run during the drilling phase of well construction due to the time, expense, and risks associated with clamping or banding cables to the drill pipe.

While some of the prior art may teach some solutions to several of these problems, the core issue of using a system of distributed fiber optic sensing technology within a durable and rugged delivery means to gather well logging data is disclosed as a way to deliver high quality information at lower cost to energy professionals.

OBJECTIVES OF THE INVENTION

Accordingly, the objectives of the present invention are (among others) to circumvent the deficiencies in the prior art and affect the following objectives:

Utilize a unique type of ruggedized sensor cables with sufficient tensile and crush strength to run between the casing and bore-hole, which can be cemented in place, and be used to gather well logging data.

Eliminate or reduce the need to up-size a wellbore to accommodate cables and sensors.

Provide for positioning of distributed fiber optic sensing means that could be installed or removed in a feasible, economic, and timely manner.

Provide a ruggedized cable of composite construction utilizing multiple reduced outside diameter sensor cables within a protective polymer sheath for impact resistance; lined with a low-friction polymer on the casing side, to reduce potential twisting during casing rotation; and lined with metal sheath on the wellbore side that is crimped onto the polymer and cables to prevent separation.

Other concepts are to use full encapsulation with dual-polymer extrusion with low-friction surface, combinations of polymers with high-strength composite materials such as carbon fiber and steel, or full metal encapsulation in a "flat-pack" arrangement with welded seams.

Provide for increased running speeds and reduced manpower and rig-time needs by eliminating rigid casing clamps at each pipe joint.

Provide for self-supporting, ruggedized instrument cable by installing rotating cable hangers at strategic intervals which results in achieving near normal run-rates during casing deployment and makeup.

Provide for rotation of the casing string through tight spots, eliminate or reduce the need for reamer runs, and improve cementing efficiency where reciprocation is required. The rotating casing hangers allow free rotation movement of the pipe and may (or may not) provide some limited axial movement of the casing with the hangers.

Providing a system of metal sheathing or encapsulation in the composite construction to induce a high magnetic flux signature and allow use of existing magnetic mapping tools when required. Such magnetic flux may be increased by adding Ferro-magnetic particles to the encapsulating polymer matrix.

Providing a system compatible with conventional plug and perforation completions, conventional frack sleeve systems, and swell packers.

Provide a system that increases the safety of personnel during running operations While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

System Overview

The present invention, in various embodiments, provides a system and method to provide rapid deployment of fiber optic sensing cables, conventional electronic cables, or hydraulic control lines in the annulus of a wellbore without the need to clamp cables to the casing or tubing string for support, the system comprising:

A cable anchor sub-assembly;

Cable carriers;

Ruggedized cable; and

Specialized surface deployment equipment.

The method in broad aspect is the use and activation of the apparatus as described.

Method Overview

The present invention system may be utilized in the context of an overall resource extraction method, wherein the instrumented wellbore cable and sensor deployment system described previously is controlled by a method having the following steps:

(1) installing the wellbore casing to the proper depth;

(2) deploying the flexible polymer cable along with anchor subassembly and intermediate cable carriers to the target location in the wellbore;

(3) connecting sensor or communication cables embedded in flexible polymer cable to surface equipment;

(4) confirming flexible polymer cable is deployed to target location in wellbore;

(5) energizing the sensors and gather geophysical data;

(6) performing well stimulation such as acidizing or fracturing, if required;

(7) checking if all data has been collected, if not, proceeding to step (2); and (8) pumping or flowing the resource from the well;

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

Figure 1:
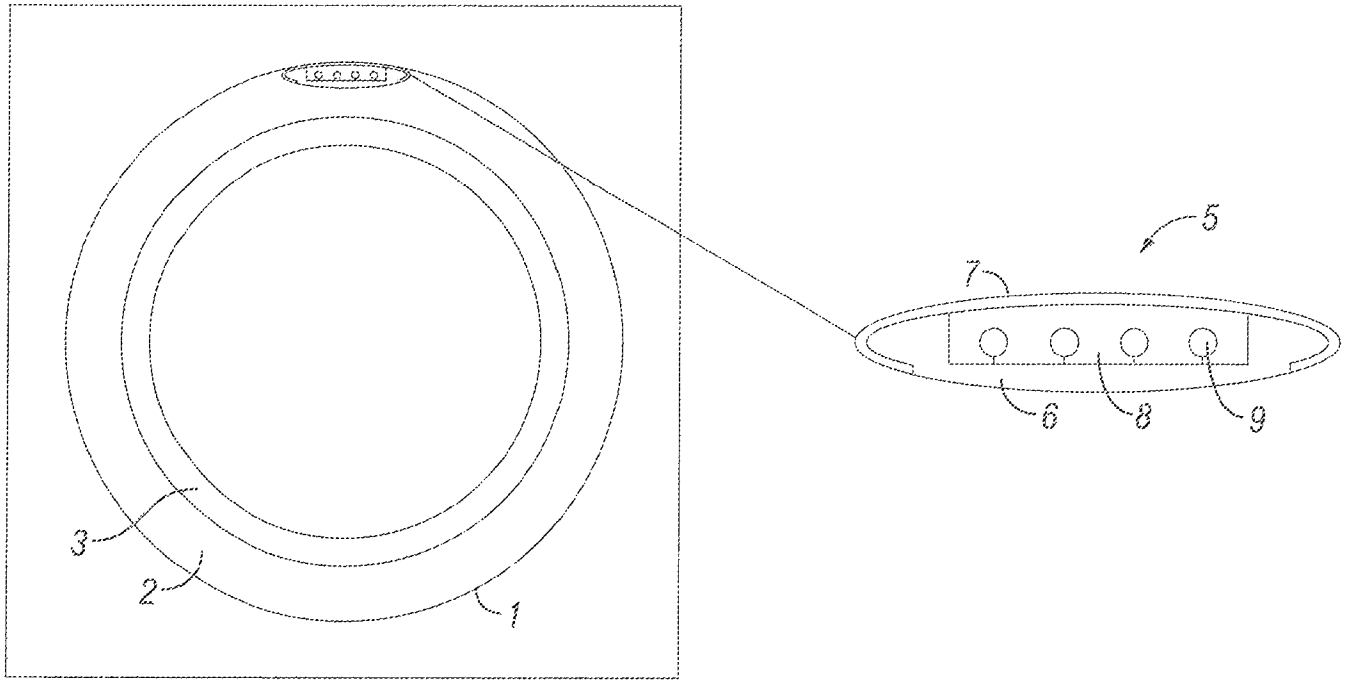
FIG. 1 is a cross-section view depicting an exemplary embodiment of the instrumented wellbore cable 5 deployed in a borehole 1.

The cable clip 21 is attached to the carrier 27 by an upper hinged bracket 28 and a lower hinged bracket 29. These brackets allow a small degree of mobility in movement of the flexible polymer cable 5.

Figure 9:
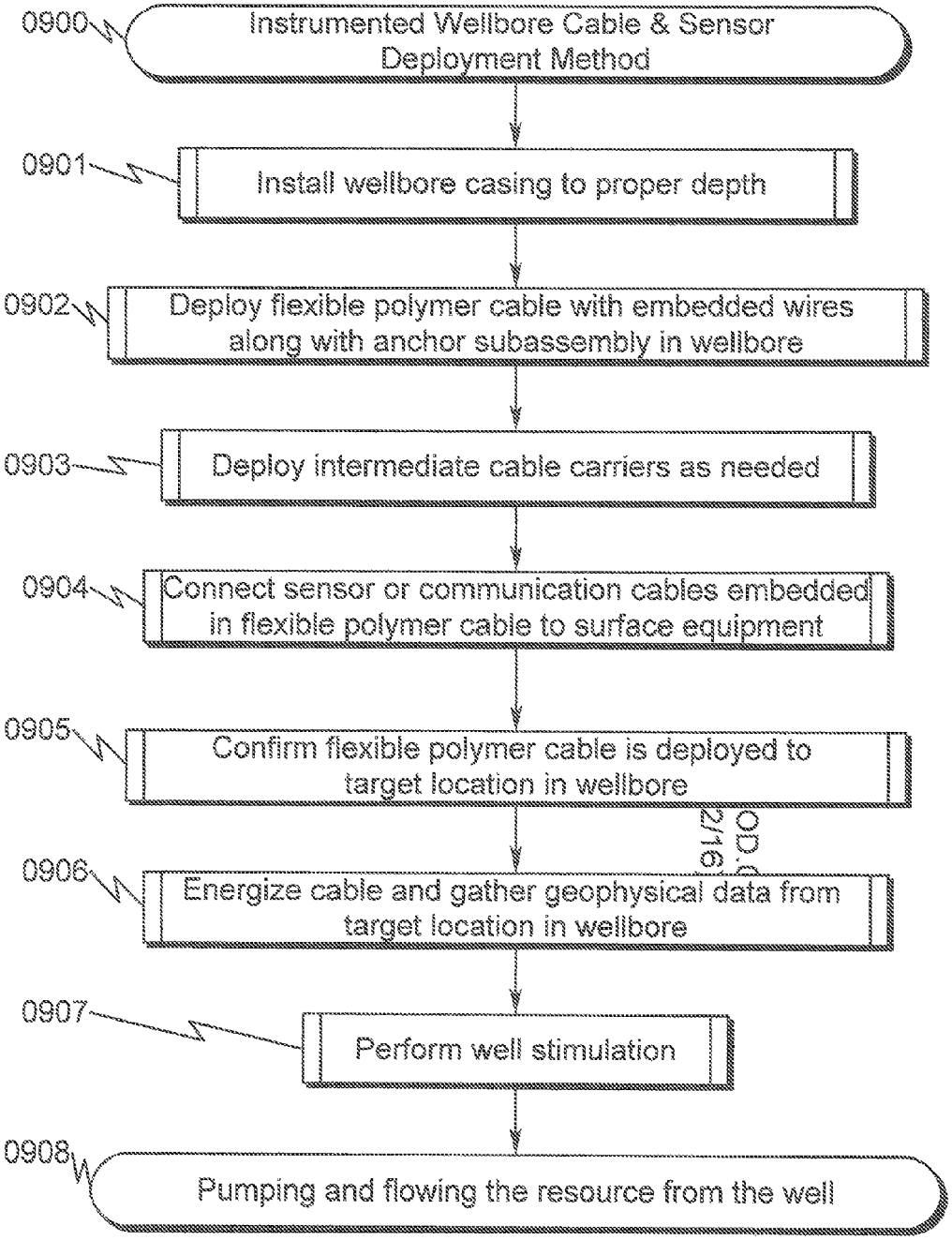

FIG. 9 illustrates an operational flowchart of a preferred exemplary embodiment of a method of using the invention.

Figure 10:
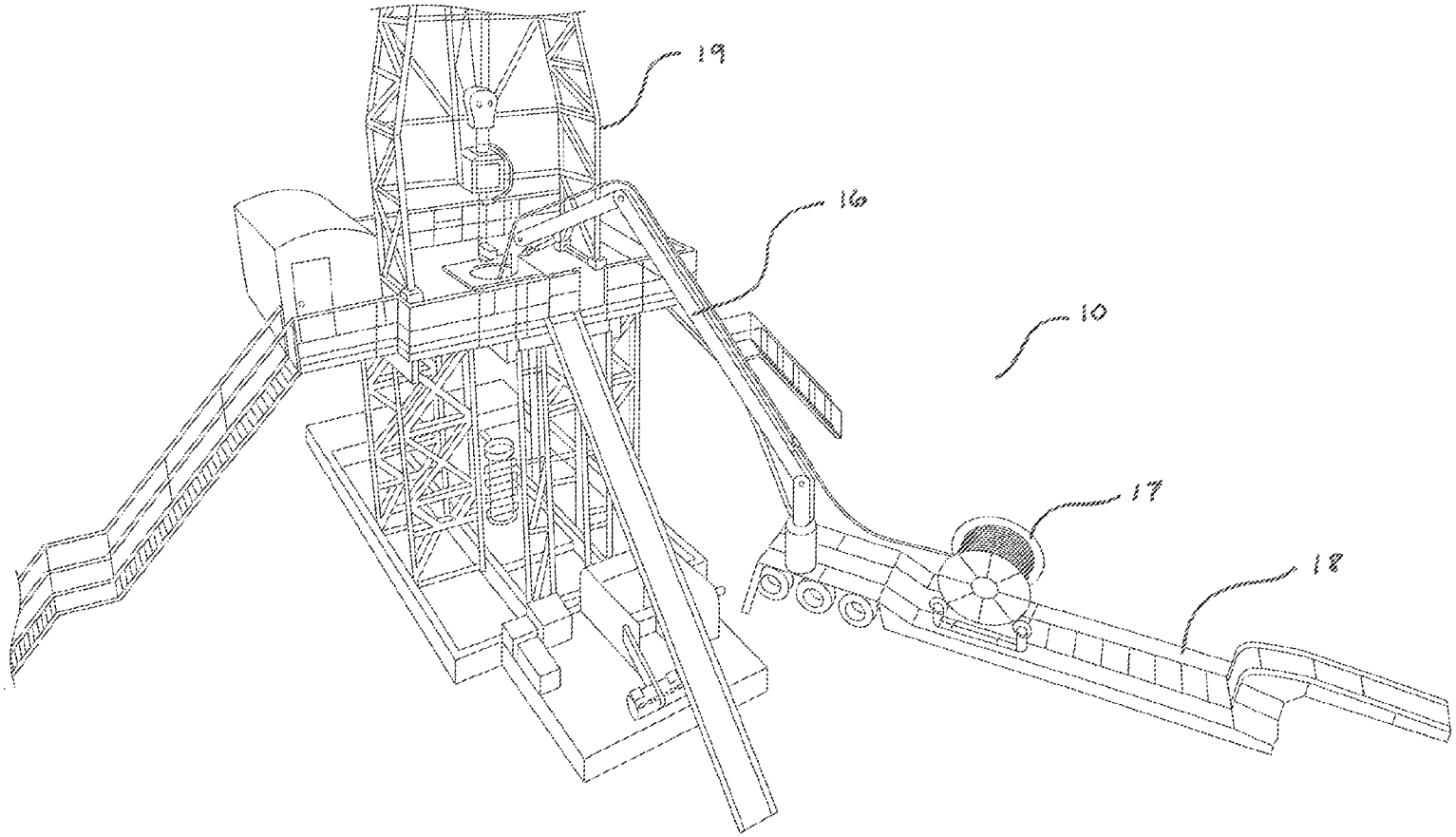

FIG. 10 illustrates an operational view of an embodiment of the cable feeder assembly 10 depicting the articulating hydraulic arm 16 and cable spool 17 mounted on a flatbed trailer situated adjacent to a drilling rig 19.

Figure 11:
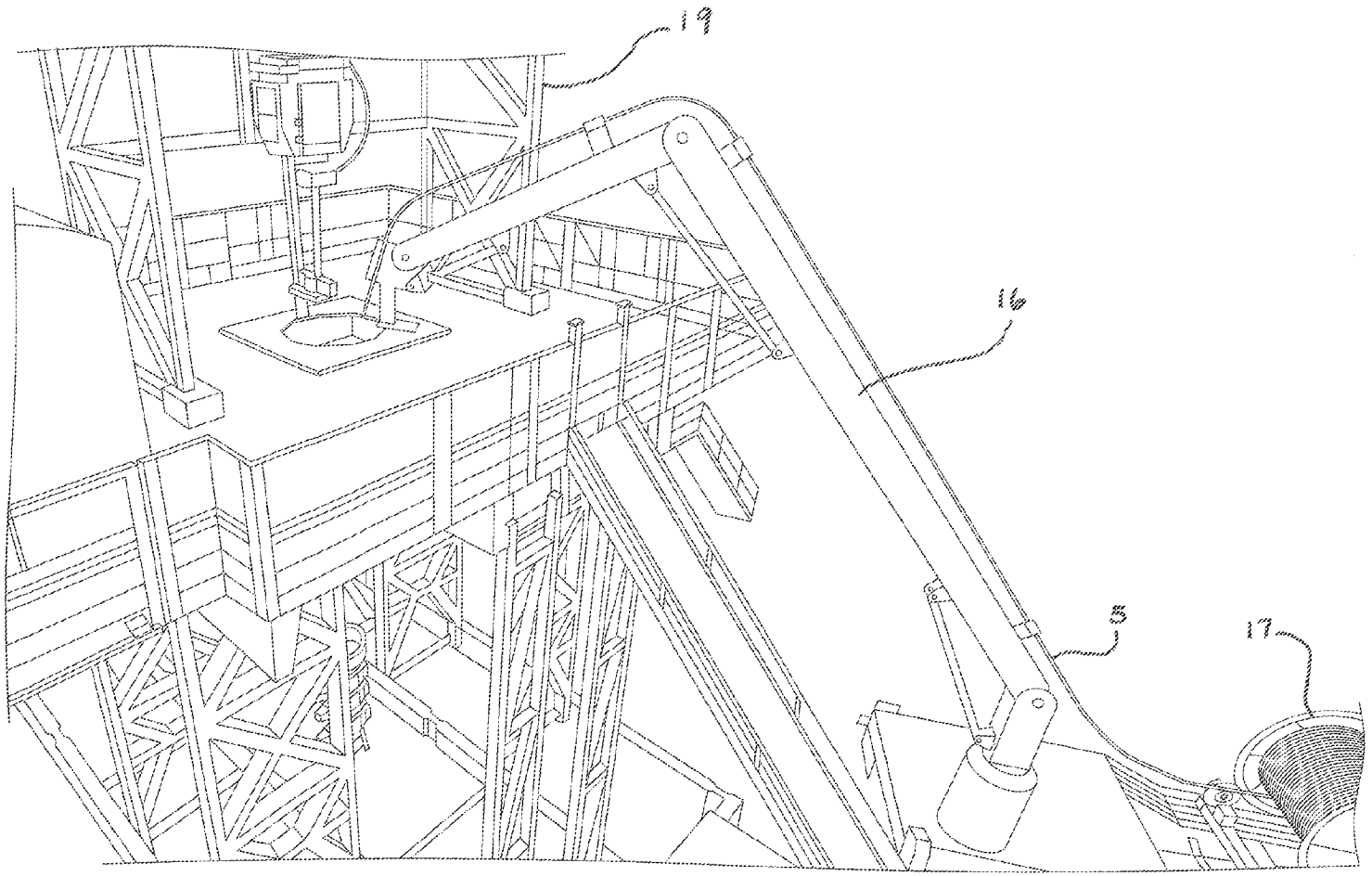

FIG. 11 illustrates an enlarged operational view of an embodiment of the articulating hydraulic arm 16 attached to the drilling rig 19.

Figure 12:
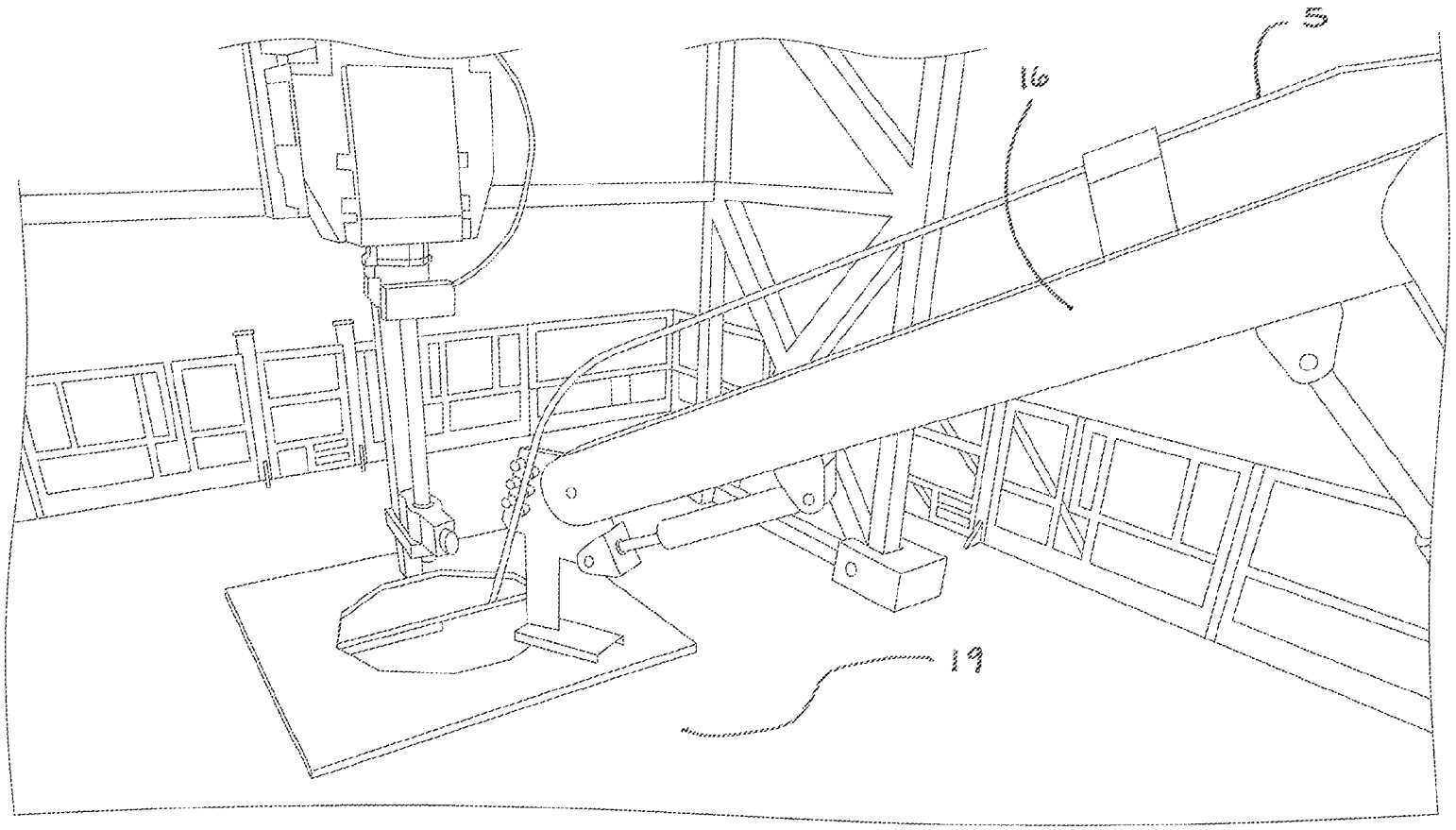

FIG. 12 illustrates an enlarged operational view of an embodiment of the articulating hydraulic arm 16 attached to the drilling rig 19 where the flexible polymer cable 5 feeds down to the wellbore 1.

DETAILED DESCRIPTION OF THE PRESENTLY PREFERRED EXEMPLARY EMBODIMENTS

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of an instrumented wellbore cable and sensor deployment system and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The present invention is an improved instrumented wellbore cable and sensor deployment system and method to gather data from areas of interest in the rock formation surrounding a wellbore by using an instrumented cable that is not rigidly attached to the casing at every joint. The apparatus allows rotation of the casing to improve running and cementing, and allows use of existing magnetic orienting tools for cable location, eliminates the need for cable sheaves hanging about the rig floor, and comprising;

(a) A flexible polymer cable with embedded wires, (b) A system for deploying said flexible polymer cable, (c) A means to hold the flexible polymer cable along a casing wall surface to allow sensing of at least one wellbore parameter.

Wherein

The system is configured to coaxially fit within a wellbore;

The system is configured to provide an articulating hydraulic arm to deploy the cable and sensors from a cable spool to the drilling rig and down into the wellbore;

The system is configured to allow rotation of the wellbore casing or tubing within the longitudinal axis of cable carriers; and The anchor subassembly and the intermediate cable carriers are configured to support the weight of the flexible polymer cable in the downhole environment.

This general system summary may be augmented by the various elements described herein to produce a wide variety of invention embodiments consistent with this overall design description.

DETAILED DESCRIPTION OF THE PREFERRED EMBODIMENTS

Referring to FIG. 1, a flexible polymer cable 5 in accordance with one preferred embodiment is shown deployed in a wellbore 1. As generally illustrated in FIG. 1, a casing 3 is deployed in a borehole with a ruggedized flexible polymer cable 5 situated adjacent to the wellbore 1 and surrounded by cement 2. The flexible polymer cable 5 comprises a plurality of sensor cables 9 (which may include fiber optic cables, electric control lines, or hydraulic control lines) with reduced outside diameter, embedded in an erosion resistant polymer 8, which is itself surrounded by a low-friction polymer 6. A metal sheath 7 is situated around the low-friction polymer 6 outside surface in such way as to protect the cable 5 from abrasive contact with the wellbore 1.

According to one aspect of a preferred exemplary embodiment, cable 5 may be deployed at desired locations to acquire geophysical information from the surrounding formation without the need for clamping the cable 5 to the wellbore casing 3.

Cable 5 may have different types of electronic or optical sensors 9 attached to or imbedded in the cable at various intervals for acquiring geophysical information.

According to another preferred exemplary embodiment, cable 5 is fully encapsulated with low-friction polymer extrusion 6 on one side for casing friction drag reduction, or full metal 7 encapsulation in a "flat-pack" arrangement with welded seams.

Figure 2:
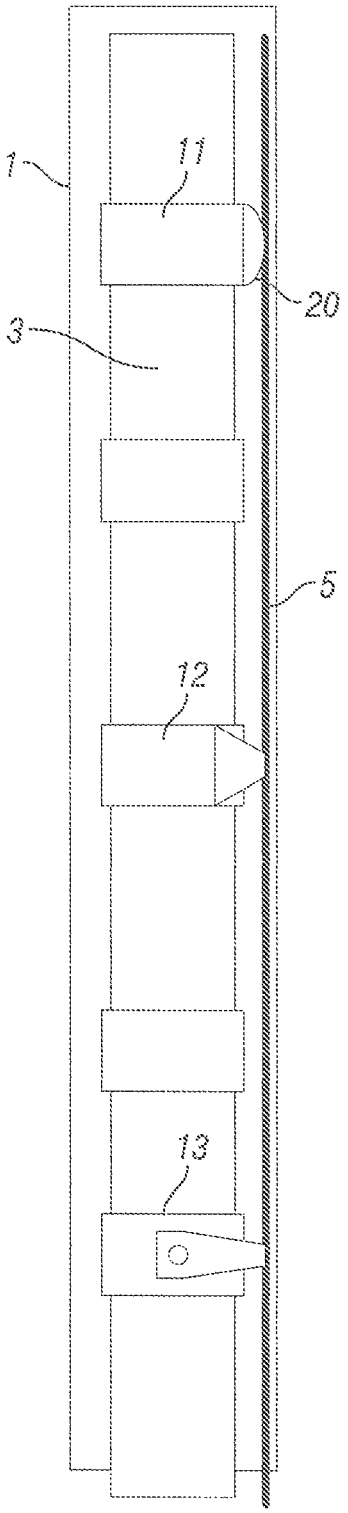
FIG. 2 is a schematic side-view of alternative arrangements of an exemplary embodiment of the invention depicting a bow-spring arm carrier 11, a semi-circular spring-loaded carrier 12, and a spring-loaded rocker arm carrier 13.

According a further preferred exemplary embodiment and referring to FIG. 2, cable 5 is not rigidly clamped to the wellbore casing 3 at each joint, leading to faster completions and reduced rig-time and manpower otherwise used to clamp sensor cables 5 to each casing 3 joint. By installing rotating cable hangers at strategic intervals the cable 5 is self-supporting in the vertical section of the wellbore 1 and near normal run-rates for casing 3 makeup and deployment are achieved. Allowing rotation of the casing string 3 eliminates or reduces the need for reamer runs, and casing 3 can be rotated through tight spots, improves cementing 2 where reciprocation is required. The rotating casing hangers 11, 12, 13 allow free rotational movement of the pipe and may provide limited axial movement of the casing 3 with the hangers 11, 12, 13.

According to yet another preferred exemplary embodiment, cementing the ruggedized cable 5 in place between the casing and the wellbore 1 eliminates or reduces the need for larger wellbore 1 diameter. Furthermore, integrating metal sheathing or Ferro-magnetic particles into the polymer matrix 6, 8 creates high magnetic flux signature for the cable 5, and allows the cable 5 to be located with existing magnetic mapping tools. Locating the the relative orientation of the cable allows perforating guns to be configured to shoot unidirectionally (instead of the typical 360 degree pattern), and avoid the cable 5 by firing the perforation guns away from the relative bearing of the cable 5.

Preferred Exemplary Instrumented Wellbore Cable and Sensor Deployment Method Flowchart As generally seen in the flow chart of FIG. 9, a preferred exemplary instrumented wellbore cable and sensor deployment method may be generally described in terms of the following steps:

(1) installing the wellbore casing to the proper location in the wellbore (0901);
(2) deploying the flexible polymer cable with the anchor subassembly in wellbore (0902);
(3) deploying intermediate cable carriers as needed (0903);
(4) connecting the sensor or communication cables embedded in the flexible polymer cable to surface equipment (0904);
(5) confirming the flexible polymer cable is deployed to the target location in the wellbore (0905);
(6) energizing the sensor or communication cables and gathering geophysical data from the target location in the wellbore (0906);
(7) perform well stimulation, as needed (0907);
(8) Pumping and flowing the resource from the well (0908).

Preferred Embodiment Side View Cable Support Carriers

Yet another preferred embodiment may be seen in more detail as generally illustrated in FIGS. 2, 3, 4 and 5, wherein cable support carriers 11, 12, 13 are slipped over the outside of casing 3 with sufficient gap to allow casing 3 to rotate and/or reciprocate inside the carrier 11, 12, or 13, while holding the cable 5 stationary relative to the borehole 1.

Figure 3:
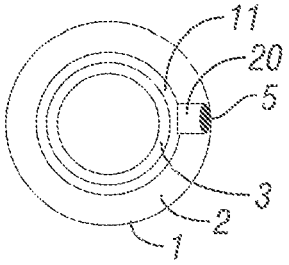
FIG. 3 illustrates a plan view of an exemplary embodiment of the bow-spring arm carrier 11.

FIG. 3 depicts a plan view of a bow-spring arm carrier 11 and bow-spring arm 20 positioned over the casing 3 and holding the cable 5 adjacent to the borehole. The bow-spring carrier 11 is free to slide along the casing 3 and allows casing 3 to rotate while the bow-spring arm 20 holds the cable adjacent to the wellbore 1.

Figure 4:
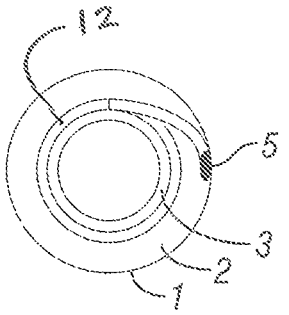
FIG. 4 illustrates a plan view of an exemplary embodiment of the semi-circular spring-loaded carrier 12.

FIG. 4 depicts plan view of a spring-loaded longitudinally hinged arm carrier 12 positioned over the casing 3 and holding the cable 5 adjacent to the borehole. The hinged-arm carrier 12 is free to slide along the casing 3 and allows casing 3 to rotate while the hinged arm carrier 12 holds the cable adjacent to the wellbore 1.

Figure 5:
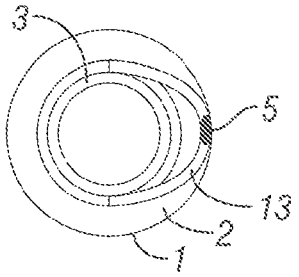
FIG. 5 illustrates a plan view of an exemplary embodiment of the spring-loaded hinged arm carrier 13.

FIG. 5 depicts plan view of a spring-loaded hinged arm carrier 13 positioned over the casing 3 and holding the cable 5 adjacent to the borehole. The spring-loaded hinged arm carrier 13 is free to slide along the casing 3 and allows casing 3 to rotate while the spring-loaded hinged arm carrier 13 holds the cable adjacent to the wellbore 1.

Preferred Embodiment Side View of an Anchor Sub-Assembly

Figure 6:
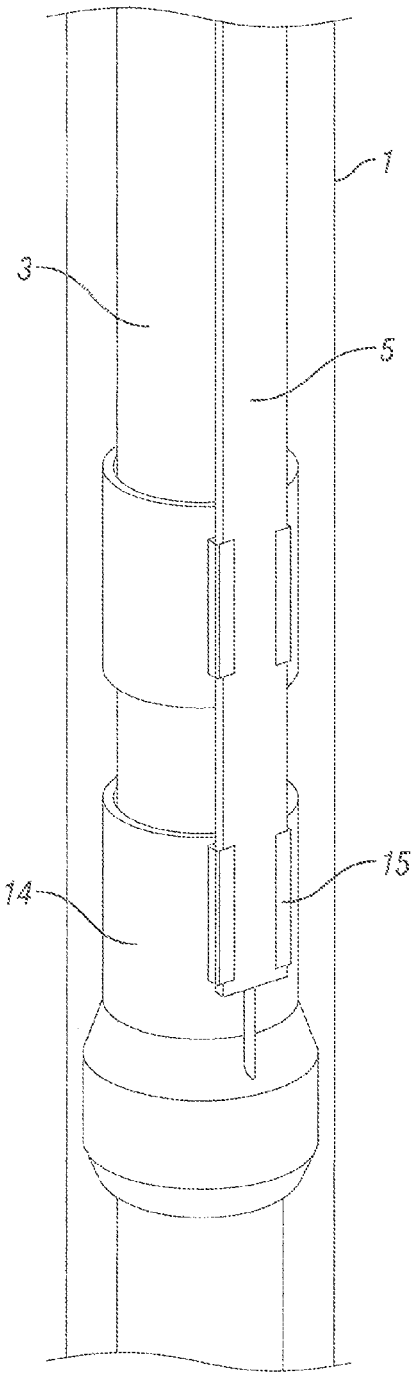
FIG. 6 illustrates an operational side view of an alternative exemplary embodiment of a cable anchor sub-assembly 14 situated on casing 3 within the wellbore 1. The figure depicts the flexible polymer cable 5 attached to the anchor sub-assembly 14 by means of a cable clip 15.

FIG. 6 depicts a preferred embodiment wherein an anchor subassembly 14 is shown downhole in place over the outer surface of a wellbore casing 3. Said subassembly 14 includes a cable clip 15 used to secure the flexible polymer cable 5 to the subassembly 14. The subassembly 14 is slipped over the casing joint 3 at the surface and the instrumented flexible polymer cable 5 is attached to the subassembly 14 before it is transited the wellbore 1 to the desired location.

Figure 7:
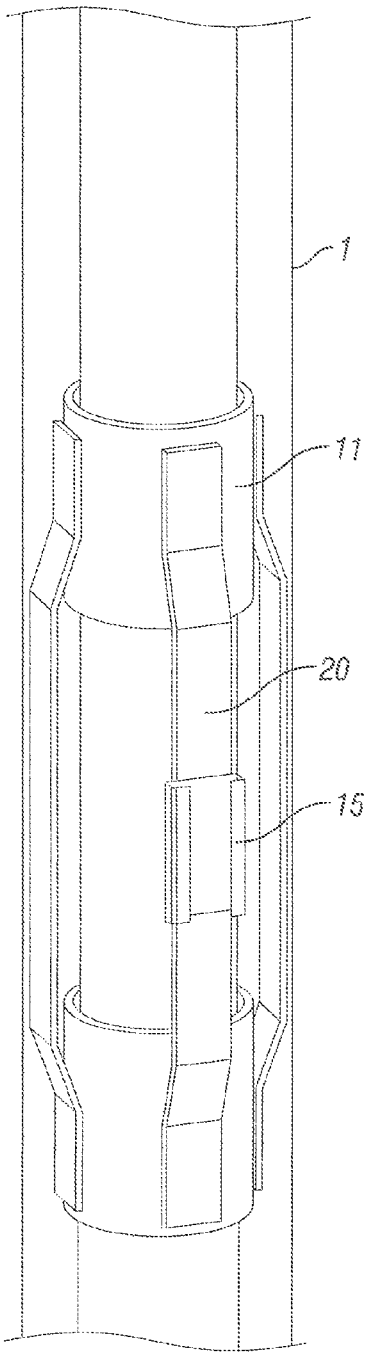
FIG. 7 illustrates an operational side view of the bow-spring carrier 11 of the apparatus shown in FIG. 3 depicting the carrier 20 and cable clip 15, without the cable 5.

FIG. 7 depicts another preferred exemplary embodiment wherein a bow-spring carrier 11 is shown without the cable 5. In the downhole environment, the bow-spring carrier 11 places the instrumented cable 5 adjacent to the wellbore wall 1 with the cable 5 secured in a cable clip 15 attached to the bow-spring arm 20. The bow-spring carrier 11 is fabricated to allow the casing 3 to easily rotate through the subassembly 14 without applying rotational force to the cable 5. A plurality of bow-spring arms 20 are situated around the bow-spring carrier 11 to strengthen the centralizing action and provide an attachment point for the cable 5.

In a preferred embodiment, only a few of the bow-spring carriers 20 would be deployed downhole in the casing string 3, thus minimizing rig-time for installation. After a completed installation to the desired location, the instrumented cables 5 can be terminated at surface points using conventional ported hangers and wellhead exits.

Figure 8:
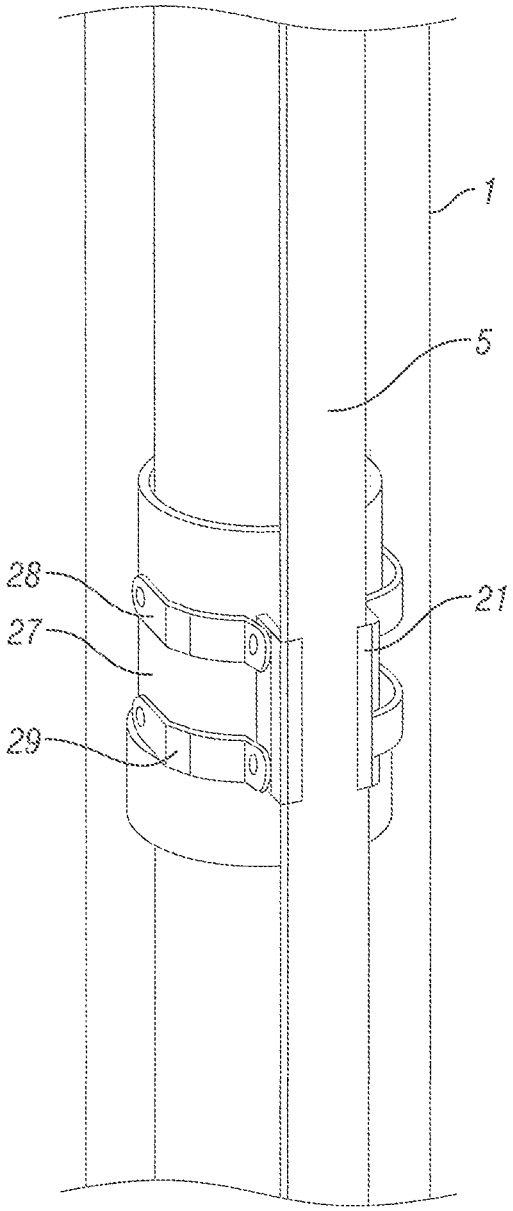
FIG. 8 illustrates an operational side view of an embodiment of a hinged cable carrier 27 depicting the flexible polymer cable 5 attached to a cable clip 21 which is attached to a hinged cable carrier 27 fabricated to allow the casing 1 to rotate through the longitudinal axis of the hinged cable carrier 27 without exerting rotational force to the cable 5.

In another preferred embodiment shown in FIG. 8, the flexible polymer cable 5 is attached to a cable clip 21 which is attached to a hinged cable carrier 27 that is situated in a downhole environment. The hinged cable carrier 27 is fabricated to allow the casing 1 to rotate through the longitudinal axis of the carrier 27 without exerting rotational force to the cable 5. The cable clip 21 is attached to the carrier 27 by an upper hinged bracket 28 and a lower hinged bracket 29. These brackets allow a small degree of mobility in the movement of the flexible polymer cable 5 in the downhole environment.

Preferred Embodiment Operational View of Cable Feeder Assembly

In another preferred embodiment shown in FIG. 10, an exemplary cable feeder assembly 10 deploys the flexible polymer cable 5 to the drilling rig 19 by an articulating hydraulic arm 16 that may be mounted on a flatbed trailer 18 along with a cable spool 17. The cable 5 feeds from the spool 17 along the articulating arm 16 to the drilling rig 19.

FIG. 11 provides an enlarged operational view of the articulating hydraulic arm 16 and the cable 5 feeding from the spool 17 along the articulating arm 16 to the drilling rig 19.

FIG. 12 provides another enlarged operational view of the articulating hydraulic arm 16 attached to the drilling rig 19. The flexible polymer cable 5 feeds along the articulating hydraulic arm 16 toward the drilling rig 19.

System Summary

The present invention system anticipates a wide variety of variations in the basic theme of extracting gas utilizing wellbore casings, but can be generalized as a wellbore isolation plug system comprising:

(a) A flexible polymer cable with embedded wires,
(b) A system for handling said flexible polymer cable,
(c) A means to hold the flexible polymer cable along a casing wall surface to allow distributed sensing of at least one wellbore parameter; and
(d) A cable feeder assembly that feeds the flexible polymer cable from the spool to the drilling rig and into the bore hole;

Wherein

The system is configured to feed the flexible polymer cable into a wellbore; and The system is configured to allow rotation of the wellbore casing or tubing within the longitudinal axis of cable carriers; and The anchor subassembly and the intermediate cable carriers are configured to support the weight of the flexible polymer cable in the downhole environment.

This general system summary may be augmented by the various elements described herein to produce a wide variety of invention embodiments consistent with this overall design description.

Method Summary

The present invention method anticipates a wide variety of variations in the basic theme of implementation, but can be generalized as an instrumented wellbore cable and sensor system comprising:

a) A flexible polymer cable with embedded wires, b) A system for handling and feeding said flexible polymer cable into a wellbore, c) A means to hold the flexible polymer cable along a casing wall surface to allow sensing of at least one wellbore parameter;

Wherein the method comprises the steps of:

(1) installing wellbore casing;

(2) deploying flexible polymer cable along with the anchor subassembly and intermediate cable carriers to a desired wellbore location in the wellbore casing;

(3) activating the sensor or communication cables embedded in flexible polymer cable at the desired wellbore location;

(4) Gathering desired geophysical data.

This general method summary may be augmented by the various elements described herein to produce a wide variety of invention embodiments consistent with this overall design description.

System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the system is further configured to be deployed from a cable spool using a hydraulic, articulating arm mounted on a flat-bed trailer adjacent to a drilling rig.

An embodiment wherein the system is further configured to allow a hydraulic articulating arm to attach to a drilling rig and guide a flexible polymer cable to the drilling rig.

An embodiment wherein the system is further configured to allow the annulus space between the casing and the wellbore to be cemented after deploying the instrumented sensor cable system to the desired wellbore location.

An embodiment wherein the formed metal jacket completely encapsulates the ruggedized sensor cable element.

An embodiment wherein the intermediate cable carriers are fabricated from material that is selected from a group consisting of: aluminum, iron, steel, titanium, tungsten, and carbide.

An embodiment wherein the flexible polymer cable material is selected from a group consisting of: a non-metal, a low-friction polymer, an erosion resistant polymer, and a metal or ceramic sheath.

An embodiment wherein the shape of the ruggedized flexible polymer cable shape is selected from a group consisting of: a flattened sphere, a crescent, an ellipse, a flattened rectangle and a flat cable.

An embodiment wherein the shape of the flexible polymer cable is a flattened ellipse or rectangle.

One skilled in the art will recognize that other embodiments are possible based on combinations of elements taught within the above invention description.

CONCLUSION

An instrumented wellbore cable and sensor deployment system and method for rapid deployment of fiber optic distributed sensing cables, conventional electronic cables, or hydraulic control lines in the annulus of a wellbore without the need to clamp cables to the casing or tubing string for support.

What is claimed is:

1. An instrumented wellbore cable and sensor deployment system comprising:

a flexible polymer cable having communication conduits embedded therein, a series of cable carriers configured to be arrayed at spaced intervals along a casing in a wellbore such that the casing may rotate freely relative to the cable carriers and suspend the flexible polymer cable parallel to and separated from the casing, wherein the flexible polymer cable is mechanically coupled to the carriers when the system is installed in a wellbore, a cable support carrier for holding the flexible polymer cable along a casing wall surface to allow sensing of at least one wellbore parameter, wherein the flexible polymer cable is suspended away from the casing wall, a cable feeder for deploying the flexible polymer cable from a cable spool to a drilling rig and onward down the wellbore.

2. The system as recited in claim 1, wherein said flexible polymer cable comprises a plurality of fiber optic cables, electrical wires, communication wires, or magnetic sensing wires.

3. The system as recited in claim 1, wherein said flexible polymer cable comprises at least one communication cable embedded within said flexible polymer cable.

4. The system as recited in claim 1, wherein said cable feeder for deploying said flexible polymer cable from a cable spool to a drilling rig comprises:

an articulating hydraulic arm of sufficient length to reach a floor of said drilling rig, the cable spool located proximate to the hydraulic arm and of sufficient size and strength to hold said flexible polymer cable, and a mechanical cable guide associated with the hydraulic arm and configured to guide the flexible polymer cable from the cable spool and into position to mechanically couple the flexible polymer cable with the cable carriers in the wellbore, when the system is being deployed.

5. The system as recited in claim 1, the cable support carrier comprising at least one cable anchor sub-assembly and at least one intermediate cable support carrier to guide said flexible polymer cable along outside of said wellbore casing, and exemplified by a type of carrier selected from the following group comprising, a. a semi-circular spring-loaded carrier, or b. a spring-loaded hinged arm carrier.

6. The system as recited in claim 5, the cable support carrier comprising a cable anchor sub-assembly for said flexible polymer cable and for anchoring at least one said fiber optic cable, but said sub-assembly allows said casing to rotate inside said cable anchor sub-assembly leaving the said flexible polymer cable to remain stationary in relation to said wellbore during rotation.

7. The system as recited in claim 6, wherein said cable anchor sub-assembly comprises a bow-spring carrier to hold the flexible polymer cable in a desired position adjacent to but not directly attached to the casing and to bear the weight of the flexible polymer cable during deployment, play-out, and reel-in of the flexible polymer cable to match movement of the casing into and out of the wellbore.

8. The system as recited in claim 7 wherein said bow-spring carrier comprises a plurality of bow-spring arms.

9. The system as recited in claim 6, wherein said cable anchor sub-assembly comprises a hinged cable carrier to hold the flexible polymer cable in a desired position adjacent to but not directly attached to the casing and to bear the weight of the flexible polymer cable during deployment, play-out, and reel-in of the flexible polymer cable to match movement of the casing into and out of the wellbore.

10. The system as recited in claim 1 further comprising, a cable anchor sub-assembly for said flexible polymer cable and termination of at least one said fiber optic cable, but which allows the casing to rotate inside the said cable termination sub-assembly leaving the said flexible polymer cable to remain stationary in relation to said wellbore during rotation.

11. The system as recited in claim 1 wherein said flexible polymer cable comprises a fabricated cable embedded with multiple smaller sensor and communication wires, and said fabricated cable having a geometric shape of elliptical or flatten rectangular cross-section.

12. The fabricated cable of claim 11 wherein said fabricated cable has one long side being encapsulated in a friction reducing material, and said friction reducing material being a polymer.

13. The fabricated cable of claim 12, wherein said fabricated cable comprises a preformed erosion resisting polymer matrix that is encapsulated within a low-friction polymer and a formed metal jacket over the long-side of said cable.

14. The fabricated cable of claim 13 wherein said formed metal jacket is comprised of thin gauge steel sufficient to protect said fabricated cable from damage during downhole transit.

15. The fabricated cable of claim 13 wherein said fabricated cable being specially constructed to contain magnetic sensing and communication elements embedded within said preformed erosion resisting polymer matrix and being partially or entirely encased in said formed metal jacket.

* * * * *